US006586690B2

(12) United States Patent
Shimomura et al.

(10) Patent No.: US 6,586,690 B2
(45) Date of Patent: Jul. 1, 2003

(54) MULTIDIRECTIONAL INPUT DEVICE SWITCHED VIA TWO MOVABLE CONTACTS

(75) Inventors: Hisato Shimomura, Miyagi-ken (JP); Shinichi Mizobuchi, Miyagi-ken (JP); Motonari Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/075,787

(22) Filed: Feb. 12, 2002

(65) Prior Publication Data

US 2002/0125111 A1 Sep. 12, 2002

(30) Foreign Application Priority Data

Mar. 12, 2001 (JP) ..... 2001-068994
Jun. 4, 2001 (JP) ..... 2001-168147

(51) Int. Cl.[7] ..... H01H 19/00
(52) U.S. Cl. ..... 200/6 A; 200/4
(58) Field of Search ..... 200/6 A, 1 K, 200/11 E, 4, 6 C, 18, 5 R, 5 A, 5 E, 6 R, 17 R, 313–315, 517; 338/128, 131, 133

(56) References Cited

U.S. PATENT DOCUMENTS 5,889,242 A * 3/1999 Ishihara et al. ..... 200/6 A
6,118,086 A * 9/2000 Isikawa ..... 200/6 A
6,160,225 A * 12/2000 Isikawa ..... 200/4
6,399,904 B1 * 6/2002 Mimata ..... 200/6 A
6,403,898 B2 * 6/2002 Janniere et al. ..... 200/6 A

FOREIGN PATENT DOCUMENTS

JP 11-73852 3/1999

* cited by examiner

*Primary Examiner*—Elvin Enad
*Assistant Examiner*—Lisa Klaus
(74) *Attorney, Agent, or Firm*—Beyer Weaver & Thomas LLP

(57) ABSTRACT

The device comprises a casing having a bottom wall with a common contact; a first fixed contact held by the casing; and a first movable contact which can be brought into or out of contact with the first fixed contact; a handle which can be tilted in many different directions to generate an electric signal; and a second movable contact which touches the common contact. The first movable contact has a contact area which touches the second movable contact. When the handle is tilted, the first fixed contact and the first movable contact touch each other to establish continuity between the first fixed contact and the common contact through the first movable contact, the contact area and the second movable contact, generating a first electric signal.

13 Claims, 10 Drawing Sheets

MULTIDIRECTIONAL INPUT DEVICE SWITCHED VIA TWO MOVABLE CONTACTS

BACKGROUND OF THE INVENTION

1. Field of the Invention

The present invention relates to a general-purpose push switch used as a button in electronic equipment such as a cellular phone or a multidirectional input device for operation of electronic equipment such as a cellular phone.

2. Description of the Related Art

Regarding the drawing for a conventional multidirectional input device, FIG. 18 shows the main part of a conventional multidirectional input device.

A case 50 is a plastic box with an opening at the top. It has an octagonal bottom wall 50*a;* projections 50*d* spaced at regular intervals which protrude upwards from the bottom wall 50*a;* a side wall 50*b* standing upwards from the side edge of the bottom wall 50*a;* and notches 50*c* made at intervals of approximately 90 degrees in the side wall 50*b.*

A first fixed contact 51 consists of a contact part 51*a* located at the top end and a terminal 51*b* extending outwards from the contact part 51*a;* the first fixed contact 51 is embedded in the bottom wall 5*a* with the contact part 51*a* exposed in the center of the bottom wall 50*a.* A common contact 52 consists of a semicircular arch contact part 52*a* and a terminal 52*b* extending outwards from the contact part 52*a.* This common contact 52 is embedded in the bottom wall 50*a* with the bottom wall 50*a* exposed on the surface of the bottom wall 50*a,* surrounding the contact part 51*a* of the first fixed contact 51.

A first movable contact 53 is made of metal. It has the shape of a dome and rests on the bottom wall 50*a* with its periphery guided by the projections 50*d.* With the first movable contact 53 in place, its side edge 53*a* remains in contact with the contact part 52*a* of the common contact 52 and its top 53*b* faces the contact part 51*a* of the first fixed contact 51. The first fixed contact 51, common contact 52 and first movable contact 53 constitute a push switch S.

A guide 54 is made of plastic and has virtually the shape of a dome. It has a base 54*b* with a through hole 54*a* at the top; an arm 54*c* supported on one side, extending towards the center from the base 54*b;* and a spacer 54*d* engaged with the arm 54*c*. This guide 54 is fixed by the base 54*b* engaged with the projections 50*d.* Once the guide 54 is fixed in this way, the arm 54*c* faces the top of the first movable contact 53.

A coil spring 55 is made of a conductive metal. It stands on the bottom wall 50*a* near the side wall 50*b,* surrounding the first movable contact 53.

A cover 60 is an octagonal flat plate with a through hole 60*a* in the center. A second fixed contact 61 consists of a contact part 61*a* at the top end and a terminal 61*b* bent at right angles from the contact part 61*a*. The second fixed contact 61 is embedded in the cover 60 every approximately 45 degrees with the terminal 61*b* exposed on the lower face of the cover 60. The cover 60 and the second fixed contact 61 are arranged so as to cover the opening of the case 50, and a U-shaped metal leg 62 is used to fix them between the case 50 and the leg 62.

A handle 64 consists of a driving body 65, a second movable contact 66 embedded in the driving body 65, and a control shaft 67 spline-connected with the driving body 65. The driving body 65 is almost cylindrical and has in its center a through hole 65*a* which runs from the top to the bottom and has an oval bottom. The second movable contact 66 is a conductive metal ring disc with outward-stretching projections 66*a* arranged at intervals of 90 degrees. The second movable contact 66 is embedded at a level almost equal to the middle of the height of the driving body 65. Made of plastic, the control shaft 67 has a cylinder 67*a* and an oval jaw 67*b* at the bottom of the cylinder 67*a*. The cylinder 67*a* is inserted through the through hole 65*a* from below the driving body 65 and the jaw 67*b* is spline-connected with the driving body 65 to control the rotation of the control shaft 67.

The handle 64 is tiltably housed in the case 50 and the top 65*b* of the driving body 65 is tiltably supported by the through hole 60*a* of the cover 60. The bottom 67*c* of the control shaft 67 is in contact with a spacer 54*d;* the second movable contact 66 is held pressed up by the coil spring 55 to be pressed against the contact part 61*a* of the second fixed contact 61. Here, since the second movable contact 66 is in contact with the coil spring 55, there is always continuity between the second movable contact 66 and the common contact 52. The second fixed contact 61 and the second movable contact 66, held pressed by the coil spring 55, constitute a tilt switch S6 which normally stays closed. The projections 66*a* of the second movable contact 66 engage with the notches 50*c* in the side wall 50*b* to prevent rotation of the entire handle 64.

Next, how the conventional multidirectional input device operates will be explained. As the control shaft 67 is tilted in a desired direction, the handle 64 tilts on a fulcrum C which is the point of contact between the contact part 61*a* of the second fixed contact 61 and the second movable contact 66 on the side opposite to the tilting direction, and the tilt switch S6 on the side of the fulcrum C stays ON while the tilt switch S6 on the opposite side turns OFF. The coil spring 55's part on the side opposite to the fulcrum C is contracted.

Also, upon tilting of the handle 64, the bottom 67*c* of the control shaft 67 bends down the arm 54*c* through the spacer 54*d* so that the first movable contact 53 is pressed and the push switch S5 turns ON.

Then, as the pressure on the control shaft 67 is released, the coil spring 55 returns to its original state and the second movable contact 66 returns to its original state as well; as a consequence, the handle 64 returns to its neutral position and the tilt switches S6 all turn ON. The arm 54*c* and the first movable contact 53 return to their original state due their elastic force so the push switch S5 turns OFF again.

When the control shaft 67 is pushed in axially with the handle 64 in its neutral position, the control shaft 67 moves down as guided by the through hole 65*a* of the driving body 65, which presses the first movable contact 53 to turn ON the push switch S5. Meanwhile, all the tilt switches S6 stay ON. Then, as the pressure on the control shaft 67 is released, the arm 54*c* and the first movable contact 53 return to their original state due to their elastic force so the push switch S5 turns OFF again and, the control shaft 67 is pushed back by the arm 54*c* and returns to its original state.

In the conventional multidirectional input device, which has the above-mentioned constitution, there has been a problem that the overall height of the device has to be large enough to accommodate the height of the coil spring 55 in order to ensure that continuity is established between the second movable contact 66 and the common contact 52 through the coil spring 55.

Another problem is that since the coil spring 55 is located near the side wall 50*b* and the common contact 52 has to be placed around the first movable contact 53, the device size should be relatively large.

A further problem is that the shape of the common contact 52 must be complicated in order to ensure that the common contact 52 touches the coil spring 55. In addition, since the arm 54*c* and spacer 54*d* lie between the first movable contact 53 and the control shaft 67, the overall height should be relatively large.

SUMMARY OF THE INVENTION

In view of the above problems, the present invention provides a low-profile, compact, multidirectional input device which does not use the coil spring 55.

As a first solution to the above problems, the present invention provides a multidirectional input device comprising: a casing having a bottom wall with a common contact; a first fixed contact held above and opposite the bottom wall by the casing; a first movable contact which is located between the bottom wall of the casing and the first fixed contact, and tiltably housed in the casing and can be brought into or out of contact with the first fixed contact; a handle having the first movable contact, which can be tilted in many different directions; and a second movable contact which touches the common contact, wherein the first movable contact has a contact area which is to touch the second movable contact; when the handle is tilted, the first fixed contact and the first movable contact touch each other and to establish continuity between the first fixed contact and the common contact through the first movable contact, the contact area and the second movable contact, generating a first electric signal.

As a second solution, in a multidirectional input device according to the present invention, the bottom wall of the casing has a second fixed contact and the second movable contact can be brought into contact with the second fixed contact when pressed, and when the handle is tilted, the first electric signal is generated and the second fixed contact and second movable contact touch each other and to establish continuity between the common contact and the second fixed contact, generating a second electric signal.

As a third solution, in a multidirectional input device according to the present invention, the casing has an interface which is facing and opposite the bottom wall with the first movable contact between the bottom wall and it, and when the handle is in its neutral position, it is pressed against a lower face of the interface due to an elastic force of the second movable contact.

As a fourth solution, in a multidirectional input device according to the present invention, the handle or the interface has an axially protruding projection, and when the interface and handle touch each other through the projection and with the handle in its neutral position, the first movable contact is out of contact with the first fixed contact.

As a fifth solution, in a multidirectional input device according to the present invention, the first movable contact has the projection (ridge) opposite the interface.

As a sixth solution, in a multidirectional input device according to the present invention, when the handle is tilted on the projection as a first fulcrum, the first fixed contact and first movable contact touch each other, and when it is tilted on the point of contact between the first fixed contact and the first movable contact as a second fulcrum, the second fixed contact and second movable contact touch each other.

As a seventh solution, in a multidirectional input device according to the present invention, the interface is a metal plate which is held and joined together with the first fixed contact by a plastic support and the handle has escapes through which convexes on the bottom wall side of the support can come and go when it is tilted.

As an eighth solution, in a multidirectional input device according to the present invention, the casing comprises a lower case having the bottom wall, and the support as an upper case separate from the lower case; the first fixed contact fitted to the upper case is fixed on the lower case to join the lower case and the upper case together.

As a ninth solution, in a multidirectional input device according to the present invention, when the handle is pushed axially, the second fixed contact and the second movable contact touch each other to establish continuity between the common contact and the second fixed contact.

As a tenth solution, in a multidirectional input device according to the present invention, the second movable contact comprises a dome-shaped leaf spring, and the contact area of the first movable contact on the handle is semispherical, protruding towards the bottom wall; and an outer semispherical surface of the contact area touches the second movable contact.

As an eleventh solution, in a multidirectional input device according to the present invention, the second movable contact comprises a dome-shaped leaf spring, and the contact area of the first movable contact on the handle has a flat portion facing the second movable contact; and the flat portion touches a top of the second movable contact.

As a twelfth solution, in a multidirectional input device according to the present invention, the second movable contact comprises a dome-shaped leaf spring, and the contact area of the first movable contact on the handle has a square or ring ridge protruding towards the second movable contact; and the ridge touches the top of the second movable contact.

As a thirteenth solution, in a multidirectional input device according to the present invention, the second movable contact comprises a dome-shaped leaf spring, and the contact area of the first movable contact on the handle has plural convexes protruding towards the second movable contact; and the convexes touch the top of the second movable contact.

BRIEF DESCRIPTION OF THE DRAWINGS

The invention will be more particularly described with reference to the accompanying drawings, in which.

DETAILED DESCRIPTION OF THE PREFERRED EMBODIMENTS

Figure 1:
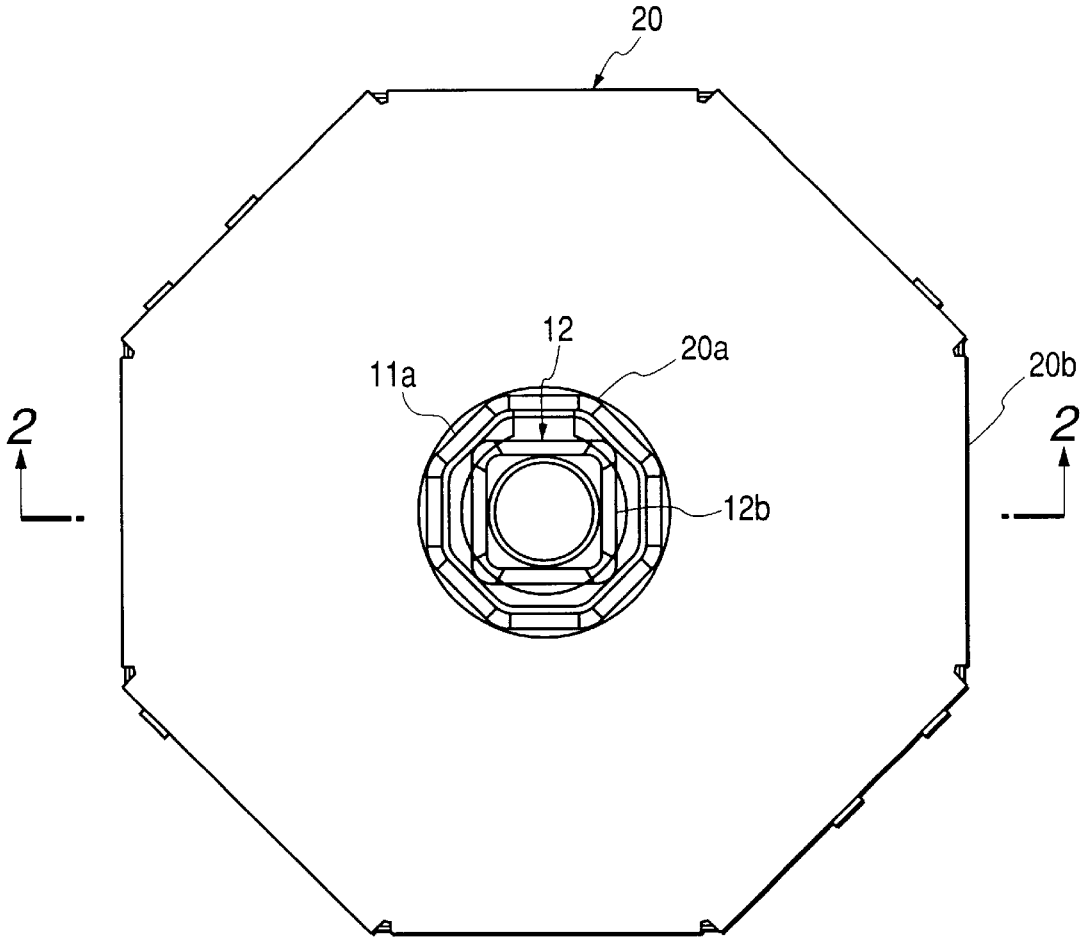
FIG. 1 is a top view of a multidirectional input device according to a first embodiment of the present invention.
Figure 2:
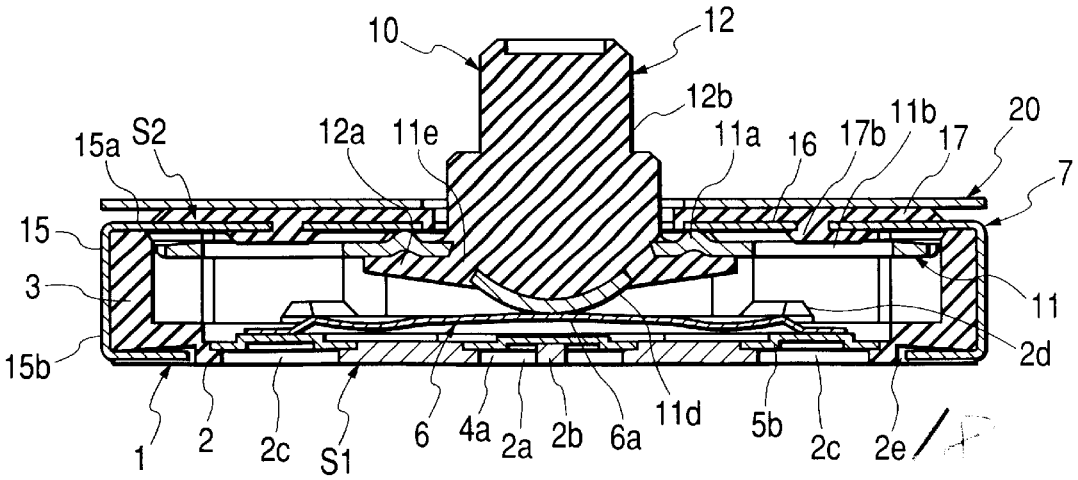
FIG. 2 is a sectional view taken substantially along the line 2—2 of FIG. 1.
Figure 3:
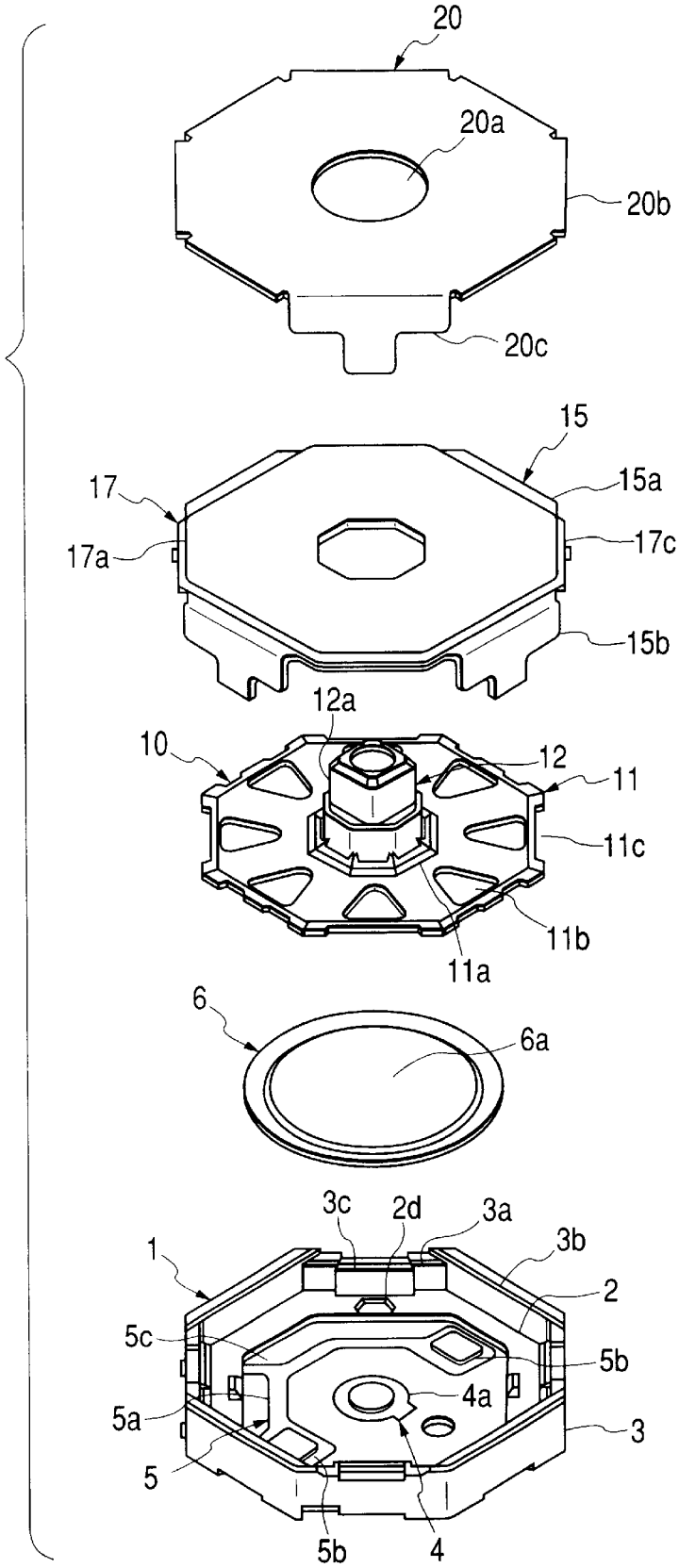
FIG. 3 is an exploded perspective view of the multidirectional input device according to the first embodiment of the present invention.
Figure 4:
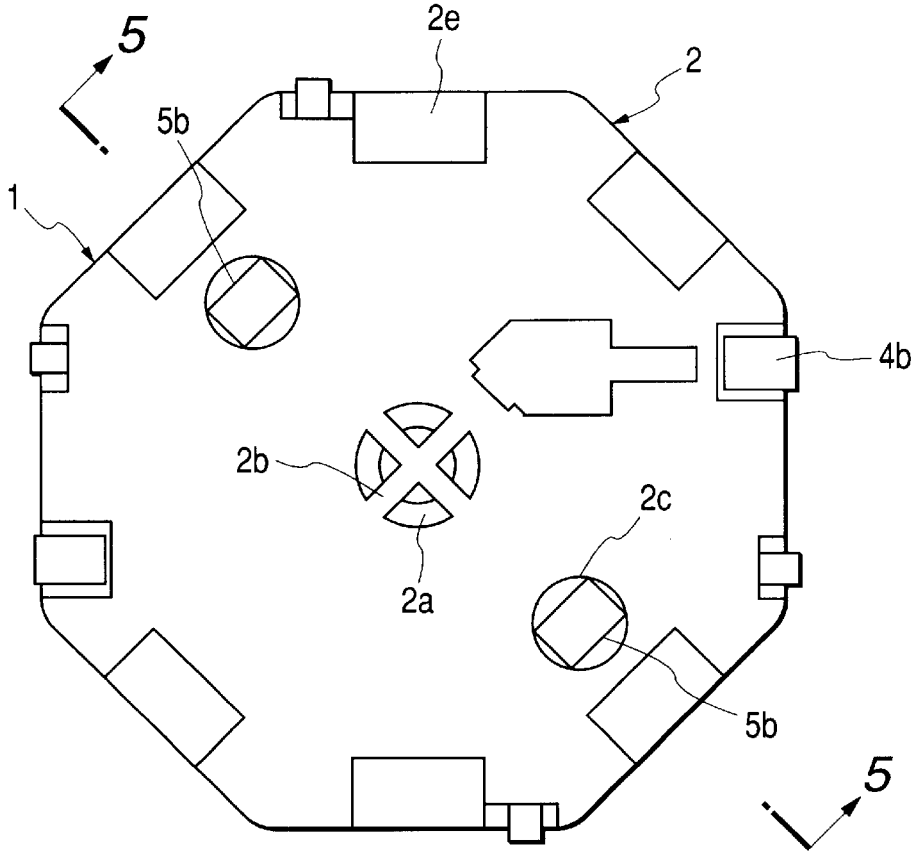
FIG. 4 is a bottom view of a lower case in the multidirectional input device according to the first embodiment of the present invention.
Figure 5:
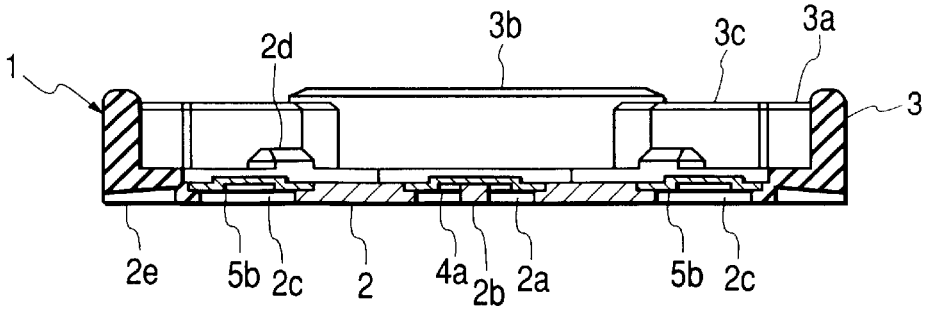
FIG. 5 is a sectional view taken substantially along the line 5—5 of FIG. 4.
Figure 6:
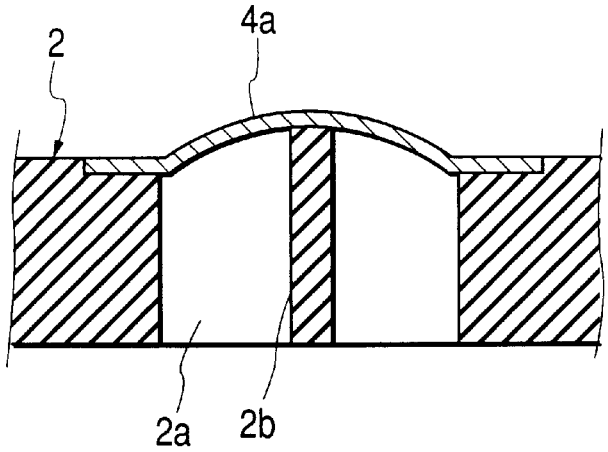
FIG. 6 is an enlarged sectional view of the main part of a push switch in the multidirectional input device according to the first embodiment of the present invention.

The drawings which illustrate the multidirectional input device as the first embodiment of the present invention are: FIG. 1, a top view of a multidirectional input device according to a first embodiment of the present invention; FIG. 2, a sectional view taken substantially along the line 2—2 of FIG. 1; FIG. 3, an exploded perspective view of the multidirectional input device according to the first embodiment of the present invention; FIG. 4, a bottom view of a lower case in the multidirectional input device according to the first embodiment of the present invention; FIG. 5, a sectional view taken substantially along the line 5—5 of FIG. 4; and FIG. 6, an enlarged sectional view of the main part of a push switch in the multidirectional input device according to the first embodiment of the present invention.

Figure 7:
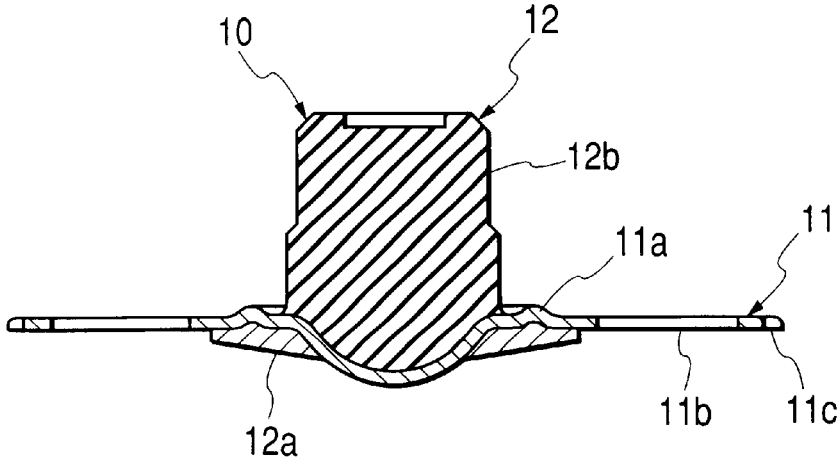
FIG. 7 is a sectional view of the main part of a handle in the multidirectional input device according to the first embodiment of the present invention.
Figure 8:
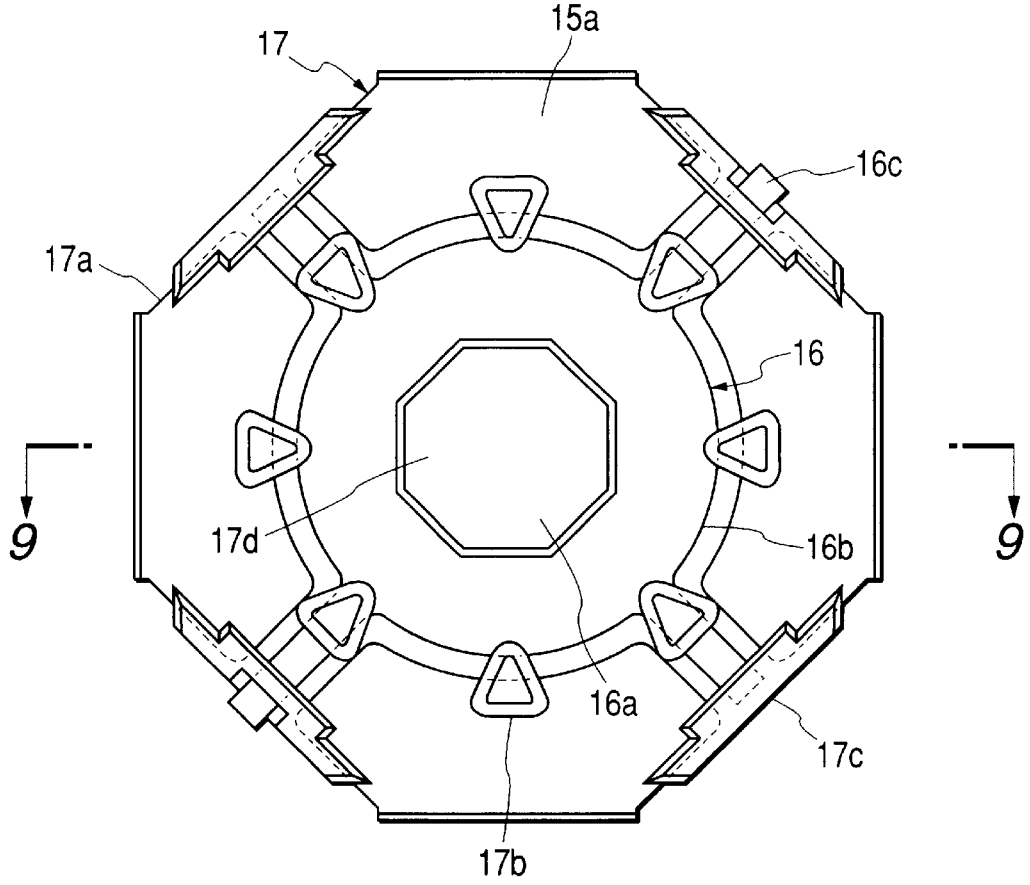
FIG. 8 is a bottom view of a support in which various members are embedded, in the multidirectional input device according to the first embodiment of the present invention.
Figure 9:
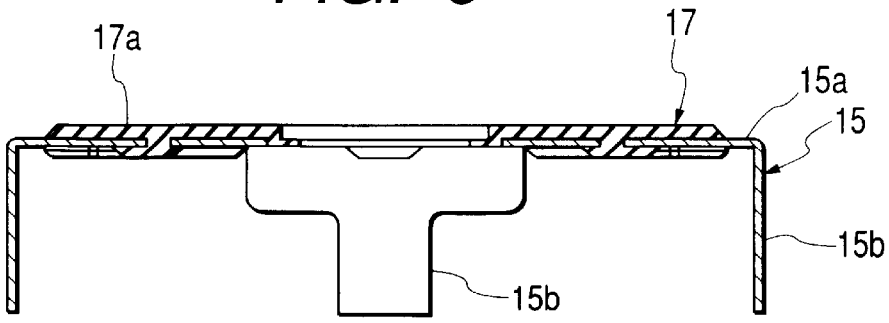
FIG. 9 is a sectional view taken substantially along the line 9—9 of FIG. 8.
Figure 10:
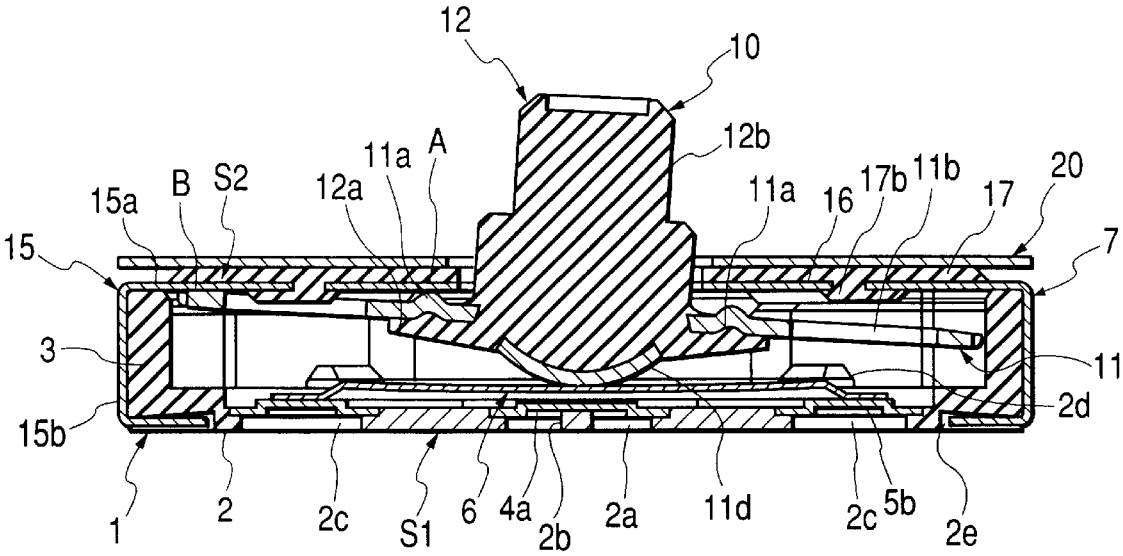
FIG. 10 is a sectional view illustrating how the multidirectional input device according to the first embodiment of the present invention operates.
Figure 11:
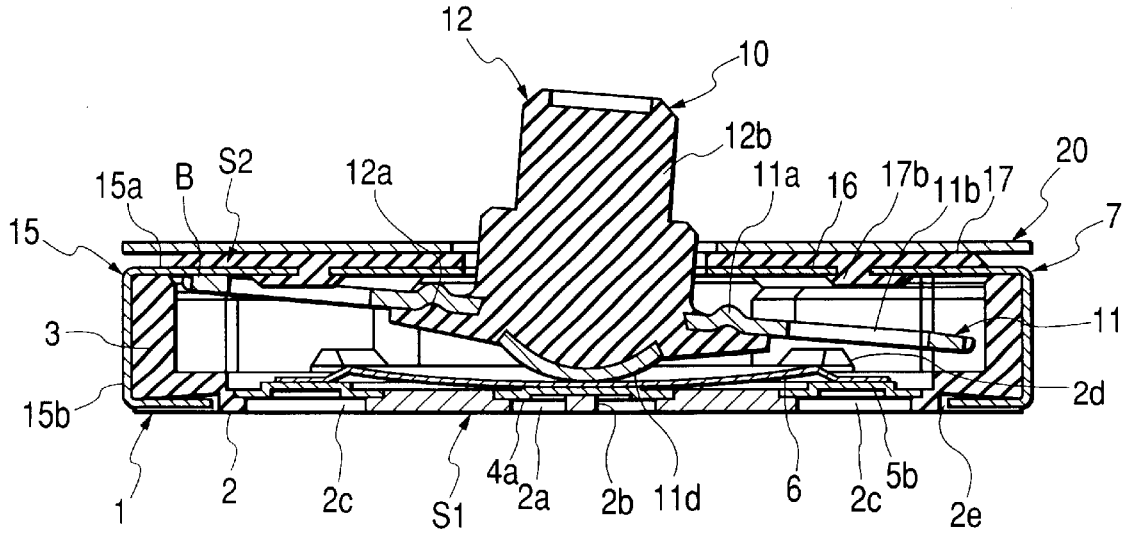
FIG. 11 is a sectional view illustrating how the multidirectional input device according to the first embodiment of the present invention operates.
Figure 12:
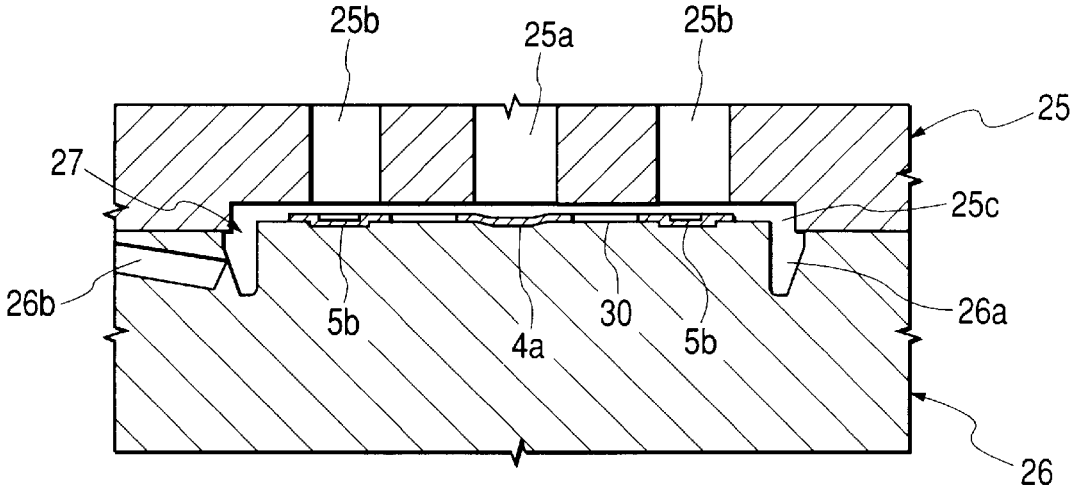
FIG. 12 is a sectional view illustrating the method for manufacturing the push switch according to the first embodiment of the present invention.
Figure 13:
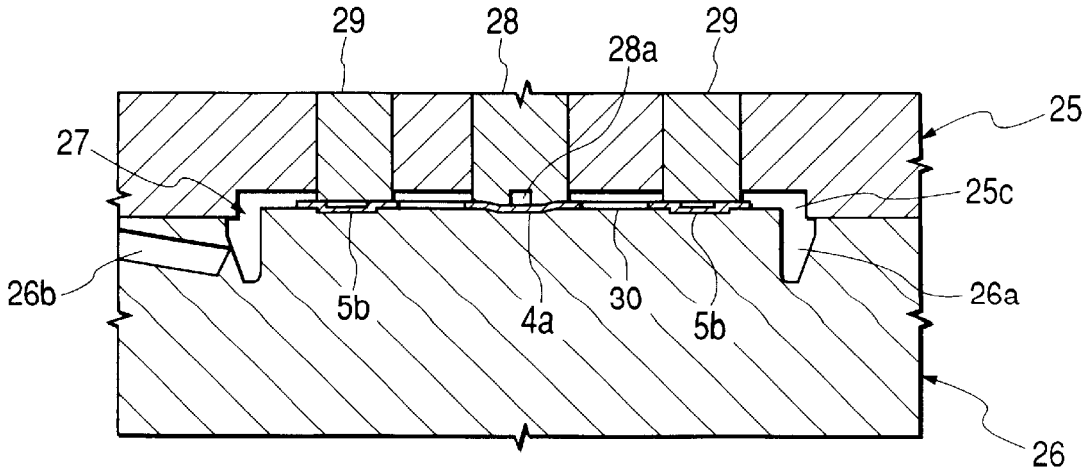
FIG. 13 is a sectional view illustrating the method for manufacturing the push switch according to the first embodiment of the present invention.

Furthermore, FIG. 7 is a sectional view of the main part of a handle in the multidirectional input device according to the first embodiment of the present invention; FIG. 8 is a bottom view of a support in which various members are embedded, in the multidirectional input device according to the first embodiment of the present invention; FIG. 9 is a sectional view taken substantially along the line 9—9 of FIG. 8; FIGS. 10 and 11 are sectional views illustrating how the multidirectional input device according to the first embodiment of the present invention operates; and FIGS. 12 and 13 are sectional views of the main part of the push switch according to the first embodiment of the present invention which illustrate the method for manufacturing the switch.

From now on, the multidirectional input device according to the first embodiment of the present invention will be described by reference to FIGS. 1 to 13. As shown in FIGS. 3 to 5, a lower case 1 has a bottom wall 2 as an octagonal flat plate, and a side wall 3 standing upright from the periphery of the bottom wall 2 where the bottom wall 2 has, in its center, four fan-shaped first holes 2*a* which run vertically, arranged along the circumference of a circle, and a cross-shaped receiver 2*b* located between these first holes 2*a,* and a pair of second holes 2*c* between which the first holes 2*a* lie. There are four projections 2*d* facing each other on the upper side of the bottom wall 2 as shown in FIG. 3 and plural concaves 2*e* facing each other along the periphery of the lower face as shown in FIGS. 4 and 5.

The side wall 3 is composed of four pairs of side walls, where each pair consists of a side wall 3*a* having a protrusion 3*c* extending towards the center, and a side wall 3*b* located next to the first side wall 3*a*; these pairs are arranged along the circumference of the bottom wall so as to form an octagonal side wall 3.

A second fixed contact 4, a metal plate, has a circular contact part 4*a* and a terminal 4*b* which extends outwards from the contact part 4*a*. The contact part 4*a* is exposed on the surface of the bottom wall 2, covering the first holes 2*a,* and the terminal 4*b* runs as follows: it is embedded outwards, exposed on the bottom surface, and again embedded, protruding sideward, with its tip folded and housed in the concave 2*e*. On the back of the contact part 4*a* of the second fixed contact 4 thus embedded is the cross-shaped receiver 2*b* passing through the center. The back of the contact part 4*a* is supported by this receiver 2*b*.

A common contact 5, a metal plate, has an arch base 5*a,* rectangular contact parts 5*b* at the ends of the base 5*a,* and a terminal 5*c* extending outwards from part of the base 5*a*. The contact parts 5*b* are exposed on the surface of the bottom wall 2 covering the pair of second holes 2*c* and the base 5*a,* located around the contact part 4*a,* is exposed on the surface of the bottom wall 2 with the tip of the terminal 5*c* folded and housed in the concave 2*e;* the common contact 5 is embedded in the bottom wall 2 in this way.

The second movable contact 6 consists of a metal dome-shaped leaf spring. Guided by the four projections 2*d* on the bottom wall 2, it is placed on the surface of the bottom wall 2. With the second movable contact 6 in place, its periphery remains in contact with the contact parts 5*b* of the common contact 5 and the top 6*a* can be brought into or out of contact with the contact part 4*a* of the second fixed contact 4. The movement of the second movable contact 6 is limited by the projections 2*d*. The second movable contact 6, second fixed contact 4 and common contact 5 constitute a push switch S1.

The handle 10 has a first movable contact 11 as a thin, octagonal metal plate, and a plastic knob 12 having the center of the first movable contact 11 embedded therein. The first movable contact 11 has the following: an octagonal ridge (convex projection) 11*a* which axially protrudes upwards in a manner to surround the knob 12; plural (eight) escapes 11*b* as triangular through holes extending outwards from this ridge 11*a* with a fringe in the periphery; concaves 11*c* around the fringe; and a semispherical contact area 11*d* in the center of the lower face. The knob 12 is a virtually square pillar having a thin plate base 12*a* and a pillar 12*b* with a square tip extending upwards from the center of the base 12*a*. The contact area 11*d* in the center of the first movable contact 11 is embedded in the base 12*a*.

When the first movable contact 11 is embedded in the knob 12, the first movable contact 11 lies radially extending outwards from the base 12*a* of the knob 12 and the contact area 11*d* lies downwards, exposed on the lower face of the base 12*a*. As shown in FIG. 2, there are plural through holes

11*e* between the first movable contact 11 and the contact area 11*d;* these through holes 11*e* are filled with resin and function as connections to join the base 12*a* of the knob 12 to the pillar 12*b*.

The handle 10 thus structured is tiltably housed in the lower case 1 in which the second movable contact 6 is placed. Here, the projections 3*c* of the first side wall 3 fit into the concaves 11*c* of the first movable contact 11 and the first movable contact 11 is guided to be housed in the lower case 1. The engagement of the concaves 11*c* and the projections 3*c* works to stop rotation of the handle 10. When the handle 10 is housed in the lower case 1, the outer surface of the contact area 11*d* of the first movable contact 11 touches the second movable contact 6. This means a contact between spherical surfaces and enables the handle 10 to tilt smoothly. Alternatively, the top 6*a* of the second movable contact 6 may be flat.

Four first fixed contacts 15 are made of metal; each of them consists of a virtually fan-shaped base 15*a* and a terminal 15*b* bent downwards from the base 15*a,* as shown in FIGS. 3 and 8. An interface 16 consists of a thin metal plate which includes a ring 16*b* with an octagonal through hole 16*a* in the center, and legs 16*c* extending in four directions from the ring 16*b*. The interface 16*b* does not always need to be made of metal; it may be made of rigid plastic resin.

The first fixed contacts 15 and the interface 16, both made of plastic resin, are embedded in the support 17 which constitutes an upper case, and integrated and fixed with the support 17. The support 17 is a plastic molding; as shown in FIGS. 3, 8 and 9, it is an octagonal thin plate which has a substrate 17*a* with an octagonal through hole 17*d* in the center, downward-protruding triangular convexes 17*b* on the lower face of the substrate 17*a,* and joints 17*c* on the fringe of the substrate 17*a* facing each other.

The first fixed contacts 15 and the interface 16 are embedded and integrated, flush with the support 17. As shown in FIG. 8, the first fixed contacts 15 are held between the substrate 17*a* and the convexes 17*b* and neighboring first fixed contacts 15 are jointed together through the joints 17*c*. In the interface 16, located nearer to the center than the first fixed contacts 15, the ring 16*b* is held between the substrate 17*a* and the convexes 17*b* and joined through the convexes 17*b* to the first fixed contacts 15 with the through hole 16*a* connected in line with the through hole 17*d* of the support 17.

The support 17 thus structured, in which the first fixed contacts 15 and the interface 16 are embedded, is fixed so as to serve as the upper case to cover the lower case 1; the support 17 as the upper case, and the lower case 1 make up a casing 7. As shown in FIG. 2, the terminals 15*b* of the first fixed contacts 15 are bent inwards to engage with the concaves 2*e* of the bottom wall 2*e* to fix the cases securely. The knob 12 of the handle 10 passes through the through hole 16*a* of the interface 16, protruding up.

When the support 17 is fixed on the lower case 1, the ridge 11*a* is pressed against the lower face of the interface 16 by the handle 10 with the elastic force of the second movable contact 6, as shown in FIG. 2. Once the ridge 11*a* is placed against the back or lower face of the interface 16, the first movable contact 11 is out of contact with the fist fixed contacts 15. The first movable contact 11 and the first fixed contacts 15 make up a tilt switch S2. The switch is usually in the OFF state, contributing to power saving.

Referring to FIG. 10, the handle 10 can tilt on the point of contact between the ridge 11*a* and the interface 16 as a first fulcrum A. As the handle 10 is tilted down, the first fixed contact 15 and the first movable contact 11 touch each other, which establishes continuity between a first fixed contact 15 and the common contact 5 through the first movable contact 11 and the second movable contact 6 (S2 turned ON), generating a direction detecting signal as a first electric signal. In other words, continuity between the terminal 15*b* of the first fixed contact 15 and the common contact 5 is established (S2 turned ON), generating a direction detecting signal.

Referring to FIG. 11, when the handle 10 is further tilted in the same direction, the handle 10 tilts on the point of contact between the first fixed contact 15 and the first movable contact 11 as a second fulcrum B. As the contact area 11*d* goes down, it presses down the second movable contact 6, which causes it to flip down, making the top 6*a* touch the contact part 4*a* of the second fixed contact 4. As a result, continuity between the common contact 5 and the second fixed contact 4 is established (S1 turned ON), generating a final signal as a second electric signal. The convexes 17*b* can get into or out of the escapes 11*b* of the first movable contact 11, which facilitates and guides tilting of the handle 10 and helps make a low-profile device.

Made of metal, the cover 20 has a base plate 20*b* with a circular through hole 20*a* in the center and legs 20*c* bent downwards from the two opposite sides of the base plate 20*b*. The cover 20 thus structured covers the surface of the support 17 and its legs 20*c* are bent inwards to engage with the convexes 2*e* of the bottom wall 2, securing the cover 20 in place. The cover 20 functions as an electrical shield and the legs 20*c* are connected with the grand pattern, etc. formed on the circuit board (not shown). This causes static electricity, etc. from outside to flow through the grand pattern, increasing the reliability in detection.

The structure of the multidirectional input device according to the present invention has been described so far. Next, how it operates will be explained referring to FIGS. 10 and 11. As the handle 10 is tilted in one of the directions of the first fixed contacts 15 arranged like a cross, the handle 10 tilts down on the first fulcrum A, which causes the first movable contact 11 and a first fixed contact 15 to touch each other and a direction detecting signal as the first electric signal is entered into the microcomputer provided on the circuit board (not shown). When the handle 10 is tilted further, it tilts down on the second fulcrum B and the contact area 11*d* presses down the second movable contact 6, which then touches the second fixed contact 4. When the second fixed contact 4 and the second movable contact 6 come into contact with each other, a final signal as the second electric signal is entered into the microcomputer (not shown), which then outputs a signal for tilting direction confirmation (final direction signal) to an external electric appliance. At this moment, the operator gets a clicking sensation upon the flipping action of the second movable contact 6 and therefore can know that the final direction signal has been generated.

As the pressure on the handle 10 is released, the second movable contact 6 returns to its original state elastically; this elastic force presses the contact area 11*d* upwards, makes the ridge 11*a* touch the interface 16. As a consequence, the handle 10 automatically returns to its neutral position or the condition shown in FIG. 2 is restored. When the handle 10 is again in the neutral position, the second fixed contact 4 and the second movable contact 6 are out of contact with each other, and the first fixed contacts 15 and the first movable contact 11 are also apart from each other. This means that both switches S1 and S2 are in the OFF state, contributing to power saving.

The handle 10 can be moved in eight directions. As the handle 10 is tilted in one (oblique) direction between neighboring ones of the first fixed contacts 15 arranged like a cross, the two first fixed contacts 15 and the second movable contact 11 touch each other and a first electric signal is entered into the microcomputer, which then recognizes that the handle 10 has been tilted obliquely. When the handle 10 is further tilted down, the push switch S1 is activated and the final signal is entered into the microcomputer, as mentioned above.

Referring to FIG. 10, when the fringe of the handle 10 is located closer to the inner wall of the side wall 3 of the lower case 1 and thus the fringe of the handle 10 slides on the inner wall as the handle 10 is tilted, this sliding motion causes the handle 10 to shift in the direction opposite to the tilting direction. Due to this shift, the fringe of the first movable contact 11 on the opposite of the tilting side slides in touch with the first fixed contact 15, which prevents dust from entering the contact part and may remove dust. Alternatively, instead of further tilting the handle 10 on the first fulcrum A, it may be pressed axially to make the second fixed contact 4 and the second movable contact 6 touch each other to turn ON the switch S1.

When the handle 10 in its neutral state is pushed axially, the first fixed contacts 15 and the first movable contact 11 are out of contact with each other, namely the tilt switch S2 is in the OFF state, while the second fixed contact 4 and the second movable contact 6 are in contact with each other, namely the push switch S1 is the ON state; thus only the second electric signal is entered into the microcomputer. In this case, the microcomputer outputs the signal from the independent push switch S1 to an external electric appliance.

When the handle 10 is tilted and pushed, the second movable contact 6 repeatedly flips down with its top 6*a* in contact with the contact part 4*a* of the second fixed contact 4 and a downward pressure is repeatedly applied to the contact part 4*a*. Since the contact part 4*a* is supported by the cross receiver 2*b*, it does not deform and stably touches or leaves the top 6*a* for switching operation.

Next, the method for manufacturing the push switch S1 will be described referring to FIGS. 12 and 13. An upper mold 25 has a first through hole 25*a* which runs vertically; a pair of second through holes 25*b* which sandwich the first through hole 25*a*; and an octagonal, shallow first concave 25*c*, while a lower mold 26 has an octagonal ring as a second concave 26*a* and a gate 26*b* which extends outwards and is partially connected with the second concave 26*a*. The upper mold 25 and the lower mold 26 are joined to make a cavity 27 through the first and second concaves 25*c* and 26*a*.

A first pin 28 is a metal cylinder which has a cross groove 28*a* cut at the tip. This first pin 28 is vertically movably held in the first through hole 25*a*. The second pins 29 are metal cylinders which are vertically movably held in the second through holes 25*b*. A contact plate 30, a metal hoop, has the second fixed contact 4 and the common contact 5 which are formed by press working.

The hoop contact plate 30 having the second fixed contact 4 and common contact 6 is placed between the upper mold 25 and the lower mold 26 and the upper and lower molds 25 and 26 are clamped. Here, the tip (groove 28*a*) of the vertically movable first pin 28 should be pressed against the back of the contact part 4*a* of the second fixed contact 4 to ensure that there is no gap between the contact part 4*a*, located inside the cavity 27, and the lower mold 26, with the cross groove 28*a* lying on the back of the contact part 4*a*. Also, the pair of second pins 29, which are vertically movable like the first pin 28, should be pressed against the back of the contact parts 5*b* of the second common contacts 5 to ensure that the contact parts 5*b*, located inside the cavity 27, do not move due to the molten resin pressure.

Then, thermoplastic resin such as polyethylene terephthalate (PET) is injected into the cavity 27 through the gate 26*b* until it is filled, so that the lower case 1 is formed with the second fixed contact 4 and common contact 5 embedded therein. Since the first pin 28 has the cross groove 28*a*, the groove 28*a* is filled with molten resin to form a cross receiver 2*b* which should support the contact part 4*a* of the second fixed contact 4. After the first pin 28 is removed, it is found that four first holes 2*a* have been formed on the back of the contact part 4*a*. After the second pins 29 are removed, it is found that second holes 2*c* have been formed extending from the back of the contact parts 5*b* of the second common contact 5.

Figure 14:
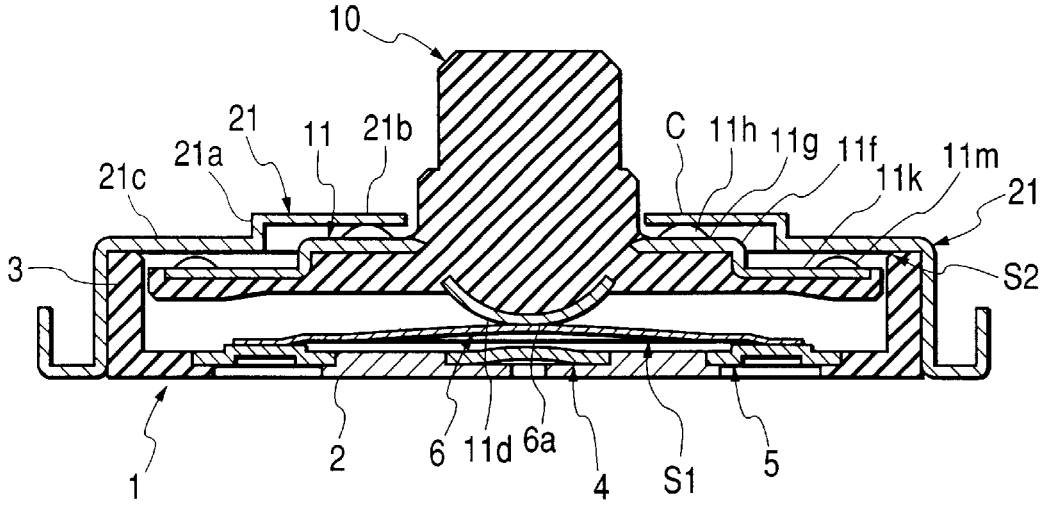
FIG. 14 is a sectional view of the main part of a multidirectional input device according to a second embodiment of the present invention.

A multidirectional input device according to a second embodiment of the present invention will be described referring to FIG. 14. FIG. 14 is a sectional view of the main part of a multidirectional input device according to the second embodiment of the present invention.

Regarding the multidirectional input device according to the second embodiment of the present invention, unlike the first embodiment in which the first movable contact 11 is a flat plate, in the second embodiment, the first movable contact 11 has a point of level difference 11*f* and a sectional profile of a flat plate with an elevated portion in the center as illustrated in FIG. 14. The point of level difference 11*f* divides the first movable contact 11 into two portions: an upper portion 11*g* located in the center, and a lower portion 11*k* as a peripheral area.

On the surface of the first movable contact 11 are plural first convexes 11*h* as projections protruding upwards from the upper portion 11*g* as well as second convexes 11*m* as projections protruding upwards from the vicinity of the edge of the lower portion 11*k*. An upper cover 21 consists of an upper portion 21*b* and a lower portion 21*c* which are divided by a point of level difference 21*a*; when the handle 64 is in its neutral position, the first convexes 11*h* are pressed against the back of the upper portion 21*b* while the second convexes 11*m* are out of contact with the back of the lower portion 21*c*, so that the tilt switch S2, composed of the first movable contact 11 and the upper cover 21, is in the OFF state. In other words, because the upward movement of the first convexes 11*h* is limited by the upper portion 21*b* of the upper cover 21, the second convexes 11*m* are out of contact with the back of the lower portion 21*c*. The other components are identical to those in the first embodiment; they are respectively marked with the same reference numerals and their explanation is omitted here.

Next, how the multidirectional input device according to the second embodiment operates will be explained. As the handle 10 is tilted in a desired direction, it tilts on the point of contact C between a first convex 11*h* and the upper portion 21*b* of the upper cover 21 as a first fulcrum, which causes a second convex 11*m* and the lower portion 11*k* to touch each other and turns ON the tilt switch S2, generating a direction detecting signal as a first electric signal. When the handle 10 is further tilted, the second movable contact 6 is pressed down by the contact area 11*d* with the point of contact between a second convex 11*m* and the lower portion 11*k* as a second fulcrum (not shown); as a result, it touches the second fixed contact 4 to turn ON the push switch S1, generating a final signal as a second electric signal. As in the first embodiment, when the pressure on the handle 10 is released, the second movable contact 6 returns to its original state and the handle 10 automatically returns to its neutral position; when the handle 10 in the neutral position is pushed axially, the push switch S1 independently turns ON. Alternatively, the top 6*a* of the second movable contact 6 may be flat.

Figure 15:
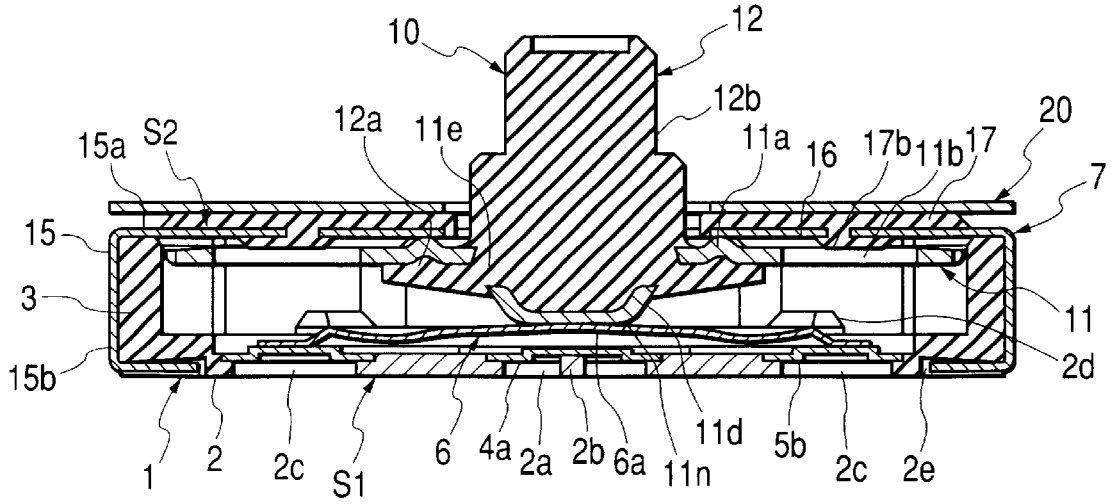
FIG. 15 is a sectional view of the main part of a multidirectional input device according to a third embodiment of the present invention.
Figure 16:
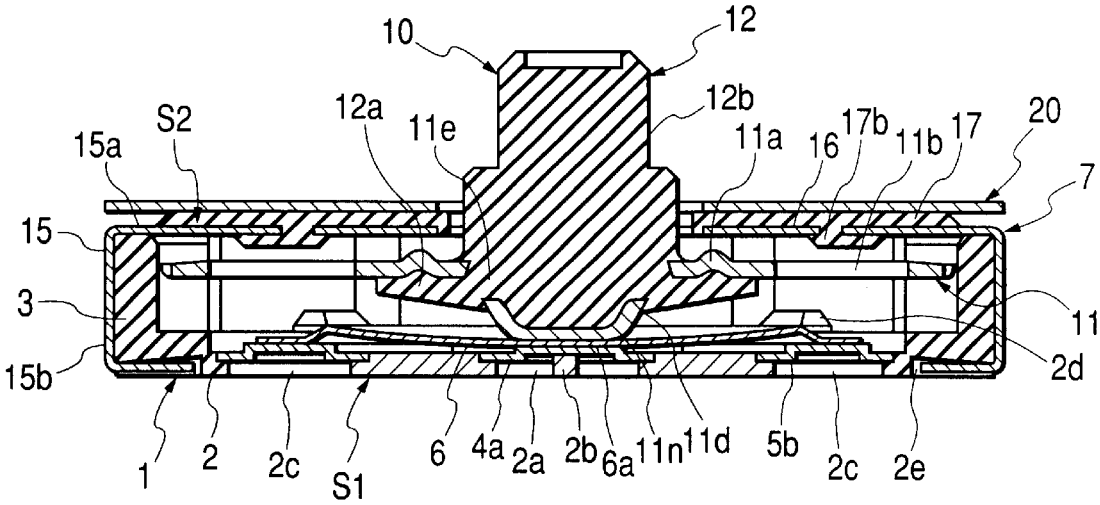
FIG. 16 is a sectional view illustrating how the multidirectional input device according to the third embodiment of the present invention operates.

A multidirectional input device according to a third embodiment of the present invention will be described referring to FIGS. 15 and 16. FIG. 15 is a sectional view of the main part of a multidirectional input device according to the third embodiment of the present invention and FIG. 16 is a sectional view illustrating how the multidirectional input device according to the third embodiment of the present invention operates.

Regarding the multidirectional input device according to the third embodiment of the present invention, unlike the first embodiment in which the contact area 11*d* of the first movable contact 11 is semispherical, in the third embodiment, the contact area 11*d* has a flat portion 11*n* facing the second movable contact 6 and the flat portion 11*n* can be brought into or out of contact with the top 6*a* of the second movable contact 6.

Due to this structure, when the handle 10 in its neutral position is pushed axially, the flat portion 11*n* presses the top 6*a* of the second movable contact 6 and flips it down and as a result of the axial movement of the handle 10, the push switch S1 turns ON. The presence of the flat portion 11*n* minimizes the possibility that the handle 10 accidentally tilts when it is pushed axially. This makes it possible to turn ON the push switch S1 only stably. Alternatively, the top 6*a* of the second movable contact 6 may be flat. If so, the flat planes of the top 6*a* and the flat portion 11*n* touch each other, so the push switch S1 only can be turned ON with more stability. Even if the top 6*a* is flat, the edge of the flat portion 11*n* is rounded, so the handle 10 can be tilted relatively smoothly. The other components are identical to those in the first embodiment; they are respectively marked with the same reference numerals and their explanation is omitted here.

Figure 17:
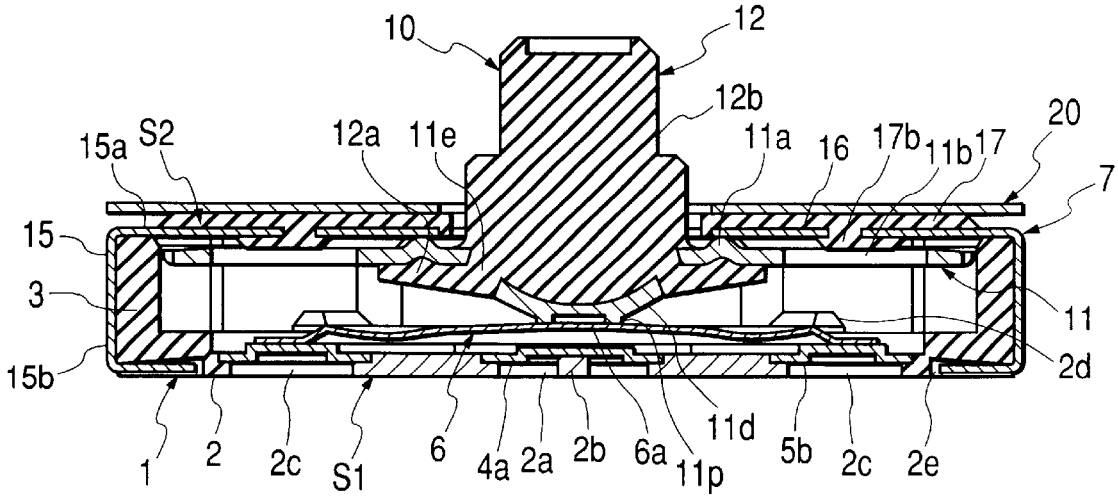
FIG. 17 is a sectional view of the main part of a multidirectional input device according to a fourth embodiment of the present invention.
Figure 18:
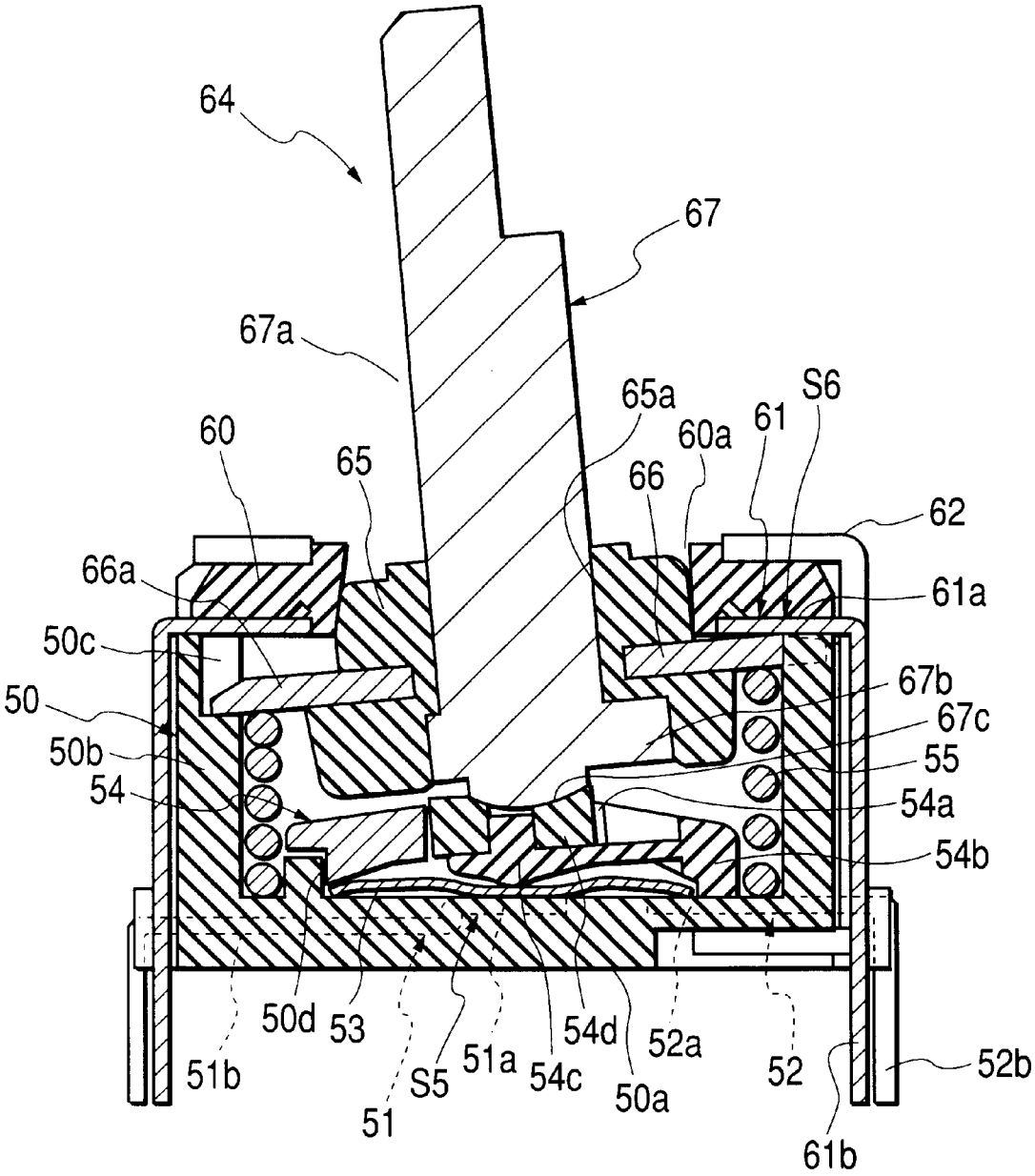
FIG. 18 PRIOR ART
FIG. 18 is a sectional view of the main part of a conventional multidirectional input device.

A multidirectional input device according to a fourth embodiment of the present invention will be described referring to FIG. 17. FIG. 17 is a sectional view of the main part of a multidirectional input device according to the fourth embodiment of the present invention.

Regarding the multidirectional input device according to the fourth embodiment of the present invention, unlike the first embodiment in which the contact area 11*d* of the first movable contact 11 is semispherical, in the fourth embodiment, the contact area 11*d* has a ring ridge 11*p* protruding towards the second movable contact 6 and the ridge 11*p* can be brought into or out of contact with the top 6*a* of the second movable contact 6.

Due to this structure, when the handle 10 in its neutral position is pushed axially, the ridge 11*p* presses the top 6*a* of the second movable contact 6 and flips it down and as a result of the axial movement of the handle 10, the push switch S1 turns ON. The presence of the ridge 11*p* minimizes the possibility that the handle 10 accidentally tilts when it is pushed axially. This makes it possible to turn ON the push switch S1 only stably. Alternatively, the top 6*a* of the second movable contact 6 may be flat. If so, only the push switch S1 can be turned ON with more stability. Even if the top 6*a* is flat, the ridge 11*p* is chamfered or rounded, so the handle 10 can be tilted relatively smoothly. The ridge 11*p* may also be a polygon such as a rectangle or octagon. Also, it is acceptable that the ridge 11*p* consists of plural arch ridges instead of a single ridge ring. Or it may consist of plural discrete ridges (projections). These ridges may be arranged along the circumference of a circle or polygon. The other components are identical to those in the first embodiment; they are respectively marked with the same reference numerals and their explanation is omitted here.

Obviously, a multidirectional input device according to the present invention may also be available in forms other than the above-mentioned. In the above-mentioned first, third and fourth embodiments, the first movable contact 11 has a ridge (projection) 11*a,* while in the second embodiment, it has first convexes 11*h* as projections protruding upwards. Alternatively, it may have a projection or projections protruding downwards from the interface 16 or the upper portion 21*b* of the upper cover 21. Although the casing 7 is a combination of a lower case 1 and a support 17 in the above-mentioned embodiments, it may also be integrally formed as a single component. In the first and second embodiments, the handle 10 has a first movable contact exposed at least partially on its lower or upper surface which is constructed by insert molding; instead, the first movable contact 11 may be joined with the base 12*a* of the knob 12 by caulking so as to cover it, namely the side face of the base 12*a* may be used to join the upper and lower surfaces. It is also acceptable that the whole handle 10 is made of metal.

In a multidirectional input device according to the present invention, the second movable contact is in contact with the handle having the first movable contact. This eliminates the need for a coil spring as used in the prior art, making it possible to construct a compact, low-profile device. Further, the shape of the common contact 5 is simpler. The contact area 11*d* and the second movable contact 6 can directly touch each other, which eliminates the need for the arm 54 and spacer 54*d* as used in the prior art, contributing to a decrease in the thinness of the device.

In a multidirectional input device according to the present invention, when the handle is tilted down, a first electric signal is generated and the second fixed contact and the second movable contact touch each other and continuity is established between the common contact and the second fixed contact, generating a second electric signal. Therefore, it is possible to provide a compact, low-profile multidirectional input device with a simpler structure which generates first and second electric signals.

In a multidirectional input device according to the present invention, the casing has an interface facing the bottom wall with the first movable contact between it and the bottom wall, and when the handle is in its neutral position, the handle is pressed against the lower face of the interface due to the elastic force of the second movable contact. The handle is thus held against the interface. Therefore, it is possible to provide a compact stable multidirectional input device with a simpler structure.

In a multidirectional input device according to the present invention, the handle or the interface has an axially protruding projection and the interface and handle touch each other through the projection, and when the handle is in its neutral position, the first movable contact is out of contact with the first fixed contact. This facilitates tilting of the handle and ensures that the first movable contact is off the first fixed contact to keep the switch in the OFF state stably.

In a multidirectional input device according to the present invention, the first movable contact has a ridge (convex projection) opposite the interface, so the ridge can be easily formed and the handle can be tilted in different directions smoothly.

In a multidirectional input device according to the present invention, when the handle is tilted on the first fulcrum, the first fixed contact and first movable contact touch each other, and when it is tilted on the second fulcrum, the second fixed contact and second movable contact touch each other. Accordingly, it is possible to provide a multidirectional input device with a simpler structure which enables operation of two switches.

In a multidirectional input device according to the present invention, the interface is a metal plate and held and joined together with the first fixed contact by the plastic support and the handle has escapes through which the convexes on the bottom wall side of the support come and go when the handle is tilted. The metal plate interface is rigid enough and the presence of the escapes makes it possible to construct a low-profile device which ensures smooth tilting of the handle.

In a multidirectional input device according to the present invention, the first fixed contact is fixed on the lower case to join the lower case and the upper case together, which means that it is easy to assemble a multidirectional input device and fix the upper case.

In a multidirectional input device according to the present invention, when the handle is pushed axially, the second fixed contact and the second movable contact touch each other and continuity is established between the common contact and the second fixed contact. Therefore, it is easy to provide a multidirectional input device with an independent push switch.

In a multidirectional input device according to the present invention, the second movable contact comprises a dome-shaped leaf spring and the contact area of the first movable contact is semispherical, protruding towards the bottom wall. The outer semispherical surface of the contact area is designed to touch the second movable contact, which means that the outer semispherical surface of the contact area moves on the second movable contact, permitting smooth tilting of the handle.

In a multidirectional input device according to the present invention, the second movable contact comprises a dome-shaped leaf spring and the contact area of the first movable contact has a flat portion facing the second movable contact. The flat portion is designed to touch the top of the second movable contact, which means that the second movable contact can be stably operated and thus a highly reliable multidirectional input device can be provided.

In a multidirectional input device according to the present invention, the second movable contact comprises a dome-shaped leaf spring and the contact area of the first movable contact has a square or ring ridge protruding toward the second movable contact. The ridge is designed to touch the top of the second movable contact, which means that the second movable contact can be stably operated and thus a highly reliable multidirectional input device can be provided.

In a multidirectional input device according to the present invention, the second movable contact comprises a dome-shaped leaf spring and the contact area of the first movable contact has plural convexes protruding toward the second movable contact. The convexes are designed to touch the top of the second movable contact, which means that the second movable contact can be stably operated and thus a highly reliable multidirectional input device can be provided.

What is claimed is:

1. A multidirectional input device comprising:

a casing having a bottom wall with a common contact;

a first fixed contact held above and opposite the bottom wall by the casing;

a first movable contact which is located between the bottom wall of the casing and the first fixed contact, and tiltably housed in the casing and is brought into or out of contact with the first fixed contact;

a handle having the first movable contact, which is tilted in many different directions; and a second movable contact which touches the common contact, wherein the first movable contact has a contact area which is to touch the second movable contact, wherein when the handle is tilted, the first fixed contact and the first movable contact touch each other to establish continuity between the first fixed contact and the common contact through the first movable contact, the contact area and the second movable contact, generating a first electric signal.

2. The multidirectional input device according to claim 1, wherein the bottom wall of the casing has a second fixed contact and the second movable contact is brought into contact with the second fixed contact when pressed, and wherein, when the handle is tilted, the first electric signal is generated and the second fixed contact and second movable contact touch each other to establish continuity between the common contact and the second fixed contact, generating a second electric signal.

3. The multidirectional input device according to claim 2, wherein, when the handle is pushed axially, the second fixed contact and the second movable contact touch each other to establish continuity between the common contact and the second fixed contact.

4. The multidirectional input device according to claim 2, wherein the second movable contact comprises a dome-shaped leaf spring, wherein the contact area of the first movable contact on the handle is semispherical, protruding towards the bottom wall, and wherein an outer semispherical surface of the contact area touches the second movable contact.

5. The multidirectional input device according to claim 2, wherein the second movable contact comprises a dome-shaped leaf spring, wherein the contact area of the first movable contact on the handle has a flat portion facing the second movable contact, and wherein the flat portion touches a top of the second movable contact.

6. The multidirectional input device according to claim 2, wherein the second movable contact comprises a dome-shaped leaf spring, wherein the contact area of the first movable contact on the handle has a square or ring ridge protruding towards the second movable contact, and wherein the ridge touches the top of the second movable contact.

7. The multidirectional input device according to claim 2, wherein the second movable contact comprises a dome-shaped leaf spring, wherein the contact area of the first movable contact on the handle has plural convexes protruding towards the second movable contact, and wherein the convexes touch the top of the second movable contact.

8. The multidirectional input device according to claim 1, wherein the casing has an interface which is facing and opposite the bottom wall with the first movable contact between the bottom wall and it, and wherein, when the handle is in its neutral position, it is pressed against a lower face of the interface due to an elastic force of the second movable contact.

9. The multidirectional input device according to claim 8, wherein the handle or the interface has an axially protruding projection, and wherein, when the interface and handle touch each other through the projection and with the handle in its neutral position, the first movable contact is out of contact with the first fixed contact.

10. The multidirectional input device according to claim 9, wherein the first movable contact has the projection (ridge) opposite the interface.

11. The multidirectional input device according to claim 9, wherein, when the handle is tilted on the projection as a first fulcrum, the first fixed contact and first movable contact touch each other, and wherein, when it is tilted on the point of contact between the first fixed contact and the first movable contact as a second fulcrum, the second fixed contact and second movable contact touch each other.

12. The multidirectional input device according to claim 8, wherein the interface is a metal plate which is held and joined together with the first fixed contact by a plastic support, and wherein the handle has escapes through which convexes on the bottom wall side of the support can come and go when it is tilted.

13. The multidirectional input device according to claim 12, wherein the casing comprises a lower case having the bottom wall, and the support as an upper case separate from the lower case, and wherein the first fixed contact fitted to the upper case is fixed on the lower case to join the lower case and the upper case together.

* * * * *